United States Patent [19]

Brackmann et al.

[11] 3,980,088

[45] Sept. 14, 1976

[54] CIGARETTE MAKING MACHINE

[75] Inventors: Warren A. Brackmann, Cooksville; Daniel DiIaani, Toronto, both of Canada

[73] Assignee: Rothmans of Pall Mall Canada Limited, Toronto, Canada

[22] Filed: Mar. 27, 1975

[21] Appl. No.: 562,447

[30] Foreign Application Priority Data

Mar. 28, 1974 United Kingdom ..... 13886/74

[52] U.S. Cl. ..... 131/84 B; 131/60; 131/110

[51] Int. Cl.[2] ..... A24C 5/18

[58] Field of Search ..... 131/84 B, 84 C, 84 R, 131/21 D, 60–66, 108–110

[56] References Cited

UNITED STATES PATENTS

| | | | |
|---|---|---|---|
| 3,034,514 | 5/1962 | Pinkham | 131/84 B |
| 3,297,040 | 1/1967 | Gamberini | 131/84 C |
| 3,548,837 | 12/1970 | Cristiani | 131/84 B |
| 3,563,249 | 2/1971 | Geyer et al. | 131/84 B |
| 3,750,678 | 8/1973 | Labbe | 131/84 C |
| 3,779,252 | 12/1973 | Brackmann et al. | 131/84 B |

FOREIGN PATENTS OR APPLICATIONS

| | | | |
|---|---|---|---|
| 813,576 | 5/1959 | United Kingdom | 131/84 B |

*Primary Examiner*—John F. Pitrelli
*Attorney, Agent, or Firm*—Sim & McBurney

[57] ABSTRACT

A cigarette filler rod forming apparatus includes a cylindrical vacuum wheel of diameter greater than the width of the chute confining the relatively wide stream rotatable about a horizontal axis, and having a recessed air-permeable and tobacco-impermeable surface on which the filler rod is formed and conveyed. A plurality of substantially arcuately arranged shallow cylindrical disc members is positioned adjacent the end of the chute across the width thereof and adjacent an arcuate length of the periphery of the vacuum wheel for forming a plurality of narrow substreams of tobacco thereon from the tobacco particles of the relatively wide stream and conveying the substreams to the recessed surface of the cylindrical vacuum wheel for formation of the filler rod thereon by gentle intact layering of the narrow substreams one on another. The filler wrapper means is provided in rod-flow relationship with the vacuum wheel to receive the filler rod from the recessed surface for compression and wrapping to form a continuous cigarette rod.

37 Claims, 13 Drawing Figures

CIGARETTE MAKING MACHINE

FIELD OF INVENTION

This invention relates to cigarette making machines, more particularly to a continuous-rod type cigarette making machine.

BACKGROUND TO THE INVENTION

Cigarette making machines of the continuous rod type generally involve the showering of tobacco particles in a relatively wide and thin chute in which the particles move vertically upwardly or vertically downwardly onto a belt which moves transverse to direction of movement of the tobacco particles in the chute, resulting in the collection of the tobacco particles on the belt as a tobacco filler rod of narrow width and of increasing depth across the width of the chute in the direction of movement of the belt. Vacuum usually is applied to the surface of the belt opposite to that on which the rod is formed in order to grip the filler rod to the belt by suction.

Following formation of the rod, which usually has a variable weight of tobacco along its length caused by a variety of factors, the rod is trimmed in order to improve the uniformity of the rod weight along the length and then is compressed to a uniform diameter prior to wrapping in paper to form a continuous cigarette rod from which cigarettes are cut. In order to provide a consistent product, it is preferred that the filler rod be as uniform as possible immediately prior to wrapping in paper.

The prior art procedures suffer from a number of drawbacks which result in unsatisfactory cigarettes and uneconomic use of tobacco. One significant drawback results from the manner of formation and conveying of the filler rod from its formation to the wrapping station. The filler rod typically is formed on and is conveyed on a substantially flat moving belt through which suction is applied and which runs in a channel between opposed stationary sidewalls which confine the rod laterally. There is therefore, frictional contact between the sidewalls and the filler rod both during its formation and conveying. Variations in the coefficient of friction between the tobacco and the sidewalls, resulting from variations in the tobacco and/or variations in the sidewalls themselves, for example, due to irregular tar build up, may lead to dislodgment of tobacco particles from the body of the rod or movement of tobacco particles to different longitudinal positions in the rod, resulting in a worsened uniformity of tobacco along its length, leading to large numbers of cigarette rejects, and, under extreme conditions, the machine may become clogged, in which event, production would have to cease until the clog is removed. Therefore, these prior art machine constructions have defects which adversely affect the quality of the product and the runability of the machine.

Further, in conventional cigarette-making procedures, the initially-formed filler rod of relatively wide width is manipulated to decrease its width during passage from the chute to the commencement of the wrapping procedure so that the rod has the desired width for feed to the wrapping procedure. This manipulation, due to the frictional contact between the constraining walls and the tobacco in the rod may increase the above-mentioned problems. Heretofore it has not been considered possible to form a filler rod having the width required for feed to the wrapping procedure, typically less than about 10 mm, particularly about 5 to about 10 mm, due to problems in control of the formation of the filler rod directly from the relatively wide tobacco stream on a thin width surface at high speeds of formation of filler rods, typically above about 4,000 cigarettes per minute, even with the application of suction to the underside of the rod-forming belt. The control problems arise from the increasing thickness of the filler rod on the surface across the width of the relatively wide stream and the decreasing influence of suction with increasing depth. Hence, the prior art necessity to form an overwide filler rod which later is compressed laterally to decrease its width to a size suitable for feed to the wrapping procedure.

SUMMARY OF INVENTION

In accordance with the present invention, these prior art problems of cigarette making machines are eliminated. In the present invention, a cylindrical vacuum wheel of diameter greater than the width of the chute confining the relatively wide stream and rotatable about a horizontal axis is provided having a recessed air-permeable and tobacco-impermeable surface on which the filler rod is formed and conveyed. A plurality of substantially arcuately-arranged shallow cylindrical disc members is positioned adjacent the end of the chute across the width thereof and adjacent an arcuate length of the periphery of the vacuum wheel for forming a plurality of narrow substreams of tobacco thereon from the tobacco particles of the relatively wide stream and conveying the substreams to the recessed surface of the cylindrical vacuum wheel for formation of the filler rod thereon by gentle intact layering of the narrow substreams one on another. The filler wrapper means is provided in rod-flow relationship with the vacuum wheel, typically on the diametrically-opposite side of the vacuum wheel from the disc members, to receive the filler rod from the recessed surface for compression and wrapping in conventional manner to form a continuous cigarette rod.

The use of the disc members to separate the tobacco particles of the relatively wide stream into narrow substreams of tobacco and assembly of the filler rod from the substreams by the gentle intact layering of the substreams one on top of another on the recessed surface provides the required control of the movement of the tobacco particles from the relatively wide stream to the filler rod to enable the high speed assembly of a filler rod having a width less than 10 mm and suitable for direct feed to the wrapper without the prior art necessity for additional lateral compression, with consequential improvements over the prior art.

Further, the confining sidewalls of the recessed rod -forming and -conveying surface move at substantially the same speed as the recessed surface and hence at substantially the same speed as the filler rod. Thus, relative movement between the filler rod and the sidewalls which define the lateral width of the rod which occurs in prior art rod forming machines, is eliminated in the present invention. By operating in this manner, therefore, the problems associated with frictional contact between the stationary confining walls and the moving rod are eliminated.

DESCRIPTION OF PREFERRED EMBODIMENTS

Figure 1:
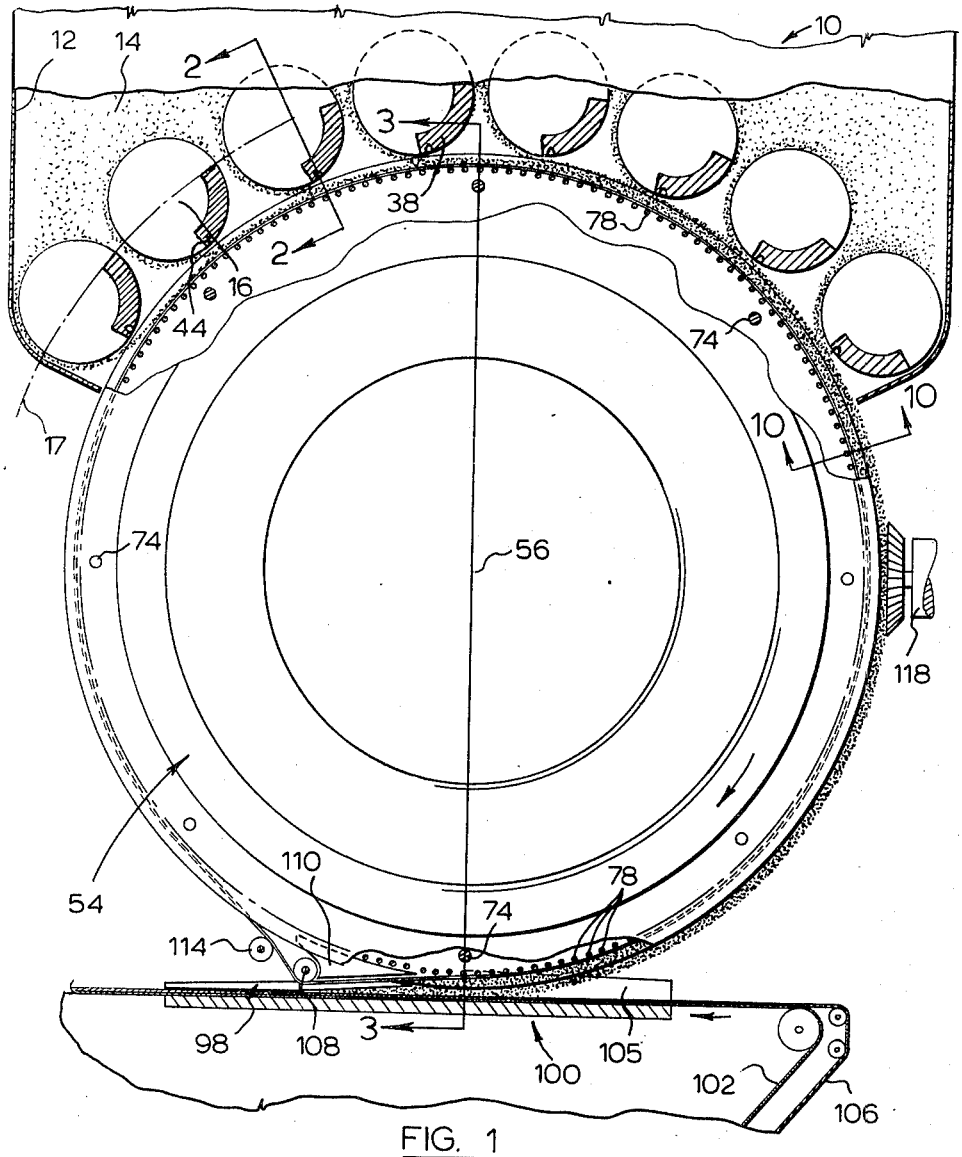
FIG. 1 is a schematic front elevational representation of a cigarette making machine constructed and operated in accordance with one embodiment of the invention.
Figure 10:
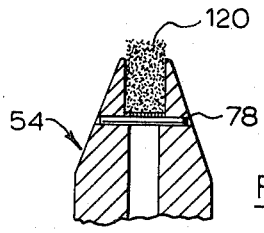
FIG. 10 is a sectional view taken on line 10—10 of FIG. 1.
Figure 2:
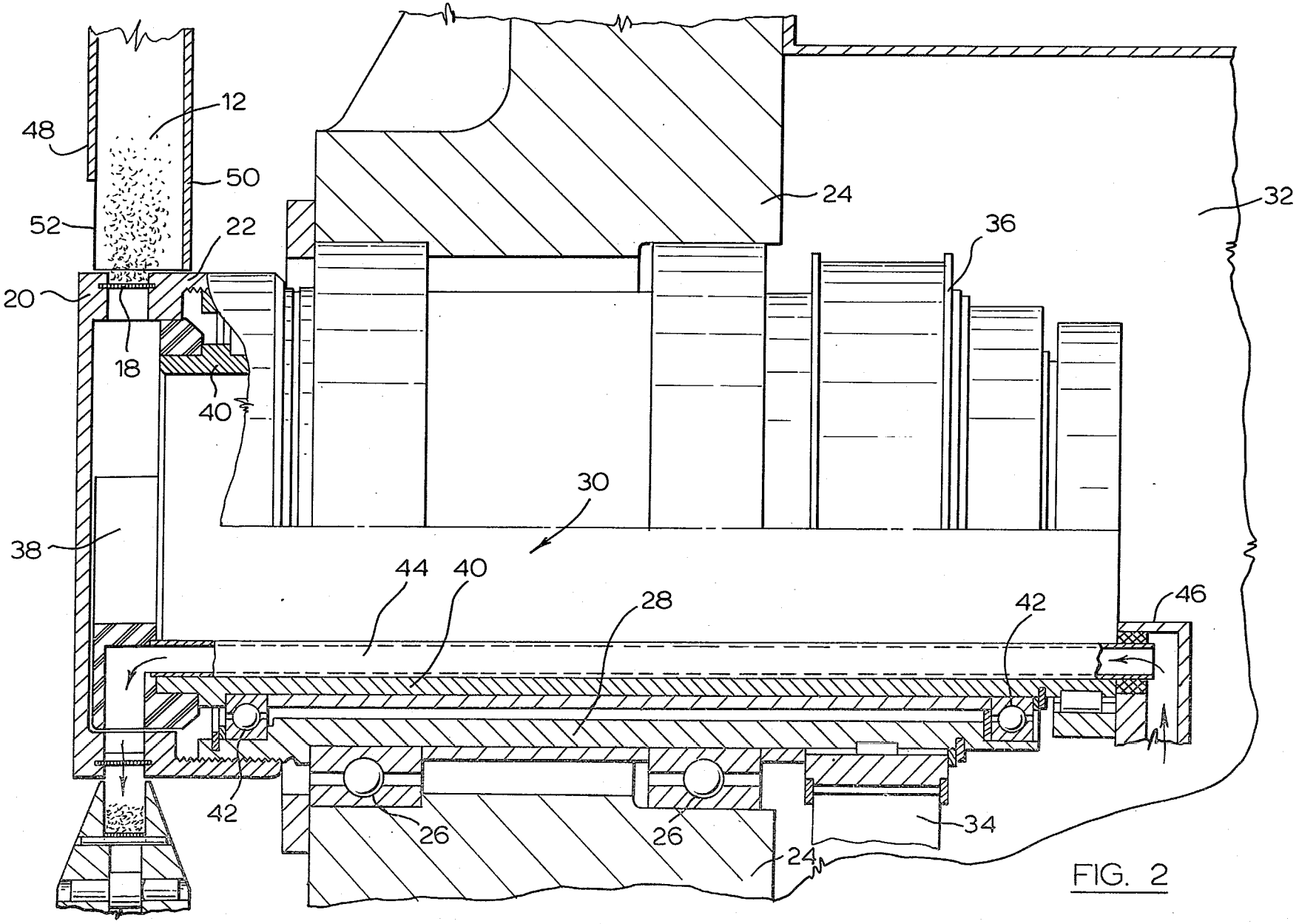
FIG. 2 is a sectional view taken on line 2—2 of FIG. 1.

Referring first to the embodiment of FIGS. 1 to 9, a cigarette making machine 10 includes a chute 12 of broad width and thin thickness for confining a falling broad stream 14 of substantially separated tobacco particles having a substantially uniform weight distribution across its width.

The falling stream of tobacco particles may be formed in any convenient manner, such as by picking tobacco particles from a carding drum conveying tobacco from a source thereof and conveying the picked tobacco as a broad band to the upper part of the chute 12.

Located towards the lower end of the chute 12 are a plurality of vacuum wheels 16, each of substantially the same diameter, arranged substantially with their rotational axes on the arc of a circle 17 and substantially perpendicular to the flow path of the broad stream 14. While eight such vacuum wheels 16 are illustrated, this is a preferred number and the invention is not limited thereto.

Each of the vacuum wheels 16 includes (see FIG. 2) a recessed air-permeable and tobacco-impermeable peripheral surface 18 supported between a front circular closure element 20 and a rear annular element 22.

Each of the wheels 16 is mounted to a stationary frame member 24 for rotation with respect thereto about the axis of the wheel 16 with the peripheral surface 18 in the flow path of the broad stream 14. Bearings 26 are provided between the stationary frame member 24 and a hub 28 of the wheel 16.

The hub 28 includes a passage 30 communicating at one end with an enclosed space 32 having a subatmospheric pressure achieved by connection to a source of vacuum. Typically, one enclosed space 32 is provided common to all the wheels 16 and connected to a single source of vacuum.

At the other end, the passage 30 communicates with the underside of the peripheral surface 18, so that the subatmospheric pressure in the enclosed space 32 induces suction across the peripheral surface 18.

A drive belt 34 engages an outer portion 36 of the hub 28 to impart rotative motion to the wheel 16. As may be seen in FIG. 9 and as described in more detail below, the wheels 16 are driven from a common drive so that they rotate at substantially the same speed.

The passage 30 has a large diameter which is comparable to that of the peripheral surface 18. This construction allows a high flow rate of air through the passage and hence a less horsepower vacuum motor is required to produce the same suction across the peripheral surface 18 than would be the case if a lesser diameter passage 30 were used.

The suction across the peripheral surface 18 also may be provided by application of subatmospheric pressure through the closure member 20, with omission of the passage 30. However, this structure is less preferred since a vacuum seal is required between rotating and stationary members and equipment is required on both sides of the peripheral surface 18, introducing possible servicing problems. It is preferred, therefore, to utilize the illustrated structure, wherein no vacuum seal is required and the vacuum producing equipment and the drive mechanism are provided on the same side of the peripheral surface 18.

A vacuum shoe 38 is provided internally of the wheel 16 and arranged to prevent the application of suction over a selected arcuate length of the peripheral surface 18. The vacuum shoe 38 forms an integral part of a stationary cylindrical member 40 defining the walls of the passage 30 and about which the hub 28 may revolve on bearings 42.

A bore 44 is formed in the cylindrical member 40 along the length thereof and terminating at one end adjacent the peripheral surface 18 and at the other end in an enclosure 46 isolating the end of the bore 44 from the enclosed space 32. The enclosure 46 is adapted to be connected to a source of compressed air for the application of air pressure across the peripheral suface 18 adjacent the one end of the bore 44.

The chute 12 has substantially parallel and vertical front and rear walls 48, 50 at least over a substantial length thereof towards the wheels 16. One or more of the front and rear walls 48, 50 of the chute 12 may taper towards the wheels 16. The chute walls 48 and 50 are oriented so that the rear wall 50 extends downwardly substantially to the annular member 22 of the wheel 16 at a location remote from the peripheral surface 18.

The front wall 48 extends downwardly in alignment with the edge of the front closure 20 adjacent the peripheral surface 18 and terminates a vertical distance from the front closure 20 so that there is a gap 52 between the lower edge of the front wall 48 and the front closure 20 thereby opening the chute 12 to atmosphere so that air drawn through the peripheral surfaces 18 by the internal suction applied to the wheels 16 is drawn through the gap 52 as well as from the chute 12 at least in the region of substream formation on the peripheral surface 18.

By using this arrangement, vacuum only is used to form substreams from the broad or relatively wide and thin stream 14 of tobacco particles as described in more detail below and additional guides may be omitted. However, cams adjacent the periphery of the annular member 22 and/or the front closure 20 may be used, if desired to force errant tobacco particles onto the peripheral surface 18.

The arcuately-arranged vacuum wheels 16 are positioned adjacent the periphery of a large vacuum wheel 54 mounted for rotation on a horizontal axis 56 which is parallel to the axes of rotation of the vacuum wheels 16. Typically, the arc 18 on which the majority of the axes of the vacuum wheels 16 are located is concentric with the axis of rotation of the large vacuum wheel 54. Ideally, the points of closest approach of the wheels 16 to the large wheel 54 should be as close as possible to attempt to get a "tangential transfer" of substreams of tobacco from the wheel 16 to the wheel 54, as explained in more detail below. Also, it is desired to have the filler rod formed on the large wheel 54 extend above the outer periphery of the wheel 54. To compromise these design desirables, the six left-hand most wheels 16 have their axes located on the arc 17 while those at the right-hand end of the arc of wheels have their axes spaced upwardly from the arc 17 an increasing but small distance towards the right-hand end.

The large vacuum wheel 54 is mounted for rotation on its axis relative to a stationary frame member 58 which may be integral with the stationary frame member 24 relative to which the vacuum wheels 16 rotate.

Bearings 60 are provided between the stationary frame member 58 and a hollow hub 62 to allow respective rotative movement. A drive belt 64 engages an outer portion 66 of the hub 62 to impart the rotative motion to the large vacuum wheel 54.

Figure 9:
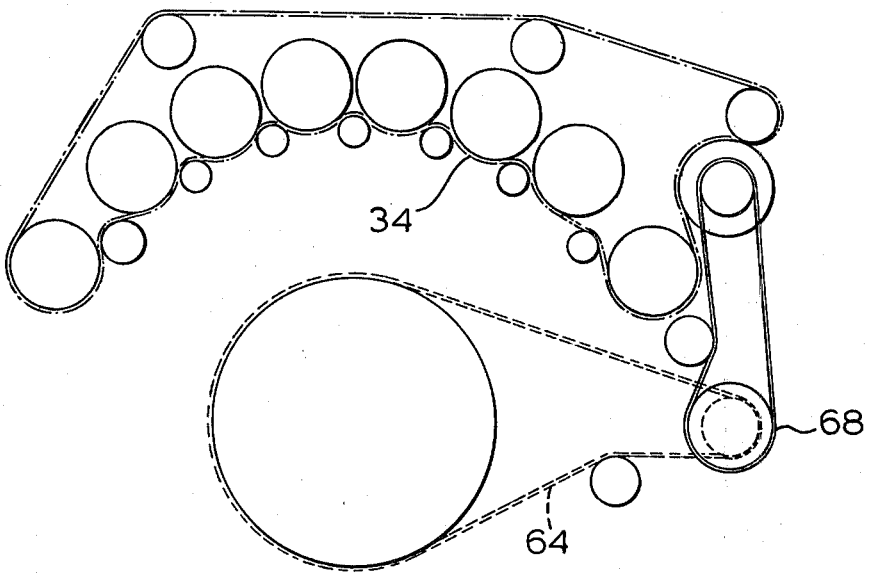
FIG. 9 is a schematic rear view of the cigarette making machine of FIG. 1 showing the drive mechanism for the apparatus.

As seen in FIG. 9, a single drive motor 68 drives the large vacuum wheel 54 and the vacuum wheels 16 through drive belt 64 associated with the large vauum wheel 54 and a common drive belt 34 associated with the vacuum wheels 16. The motor 68 also typically drives other drivable members of the machine 10, such as the wrapper device feed and the tobacco feeder to the chute 12, so that each member of the machine 10 is driven at preset speed differentials with each other from a single drive motor 68. Appropriate gearing, typically in the form of timing pulleys of different diameters, is used to provide a peripheral speed of the large vacuum wheel 54 which is substantially that of each of the vacuum wheels 16.

Figure 3:
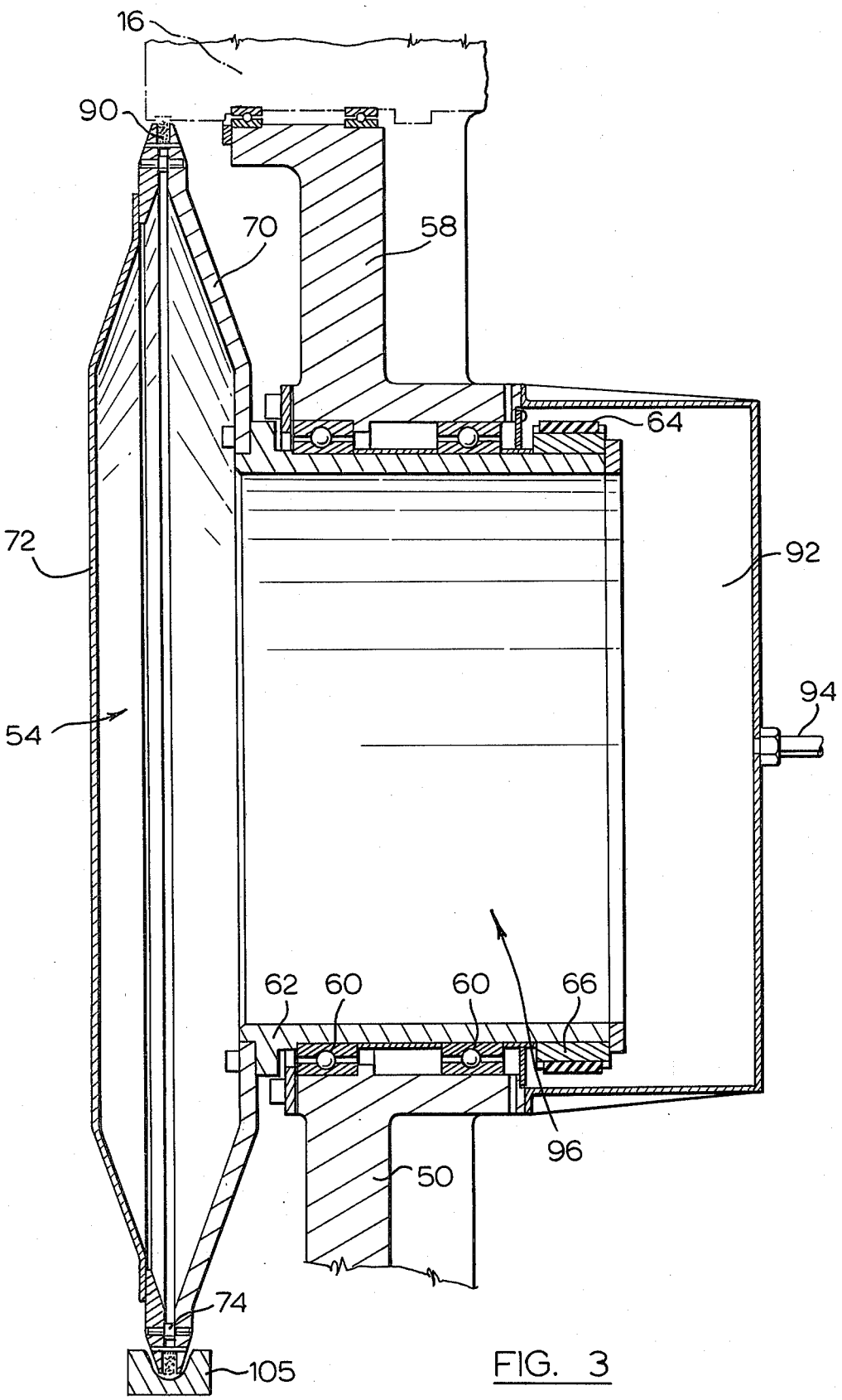
FIG. 3 is a sectional view taken on line 3—3 of FIG. 1.
Figure 4:
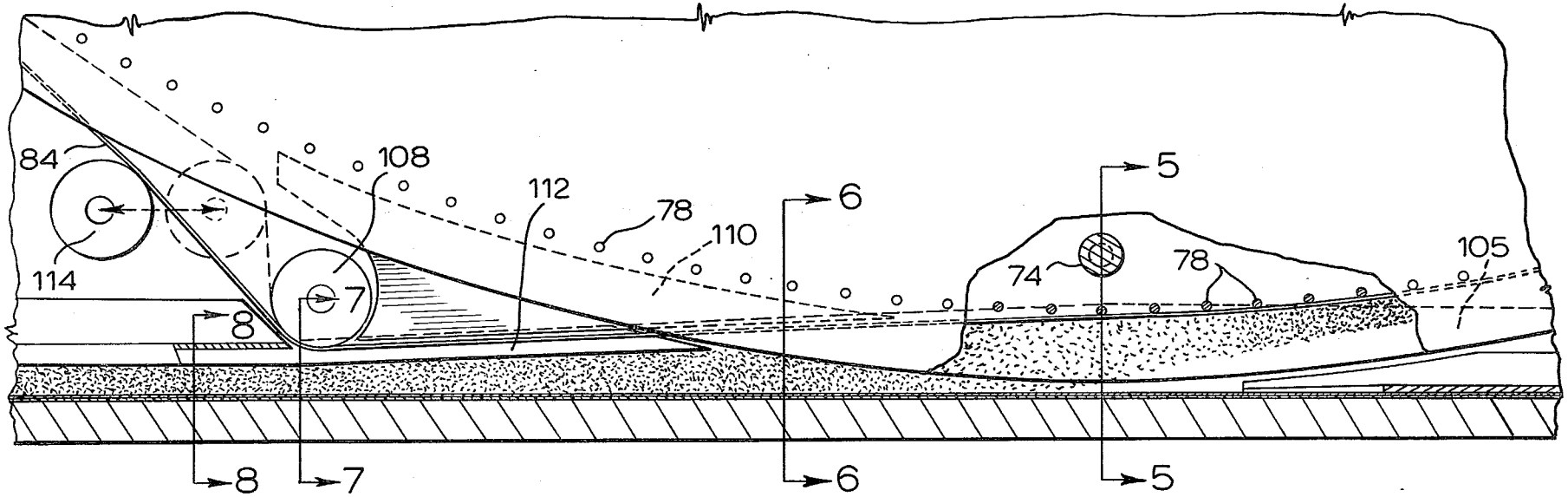
FIG. 4 is a close-up view of the portion of the machine adjacent the filler rod wrapper.

Reverting to FIG. 3, connected to the hub 62 is a dished annular flange member 70 which is joined to a circular front closure 72 of diameter substantially that of flange member 70. The flange member 70 is joined to and spaced from the front closure 72 in any convenient manner, such as, by a plurality of pins 74 positioned in interference fit with both the flange member 70 and the front closure 72 and having a central spacer element 76 maintaining the flange member 70 and the front closure 72 a predetermined distance apart.

Located closer to the periphery of the wheel 54 than the joining pins 74 and extending between the flange member 70 and the front closure 72 are a plurality of circumferentially-adjacent pins 78 substantially equally spaced from each other. These pins 78 define with continuous shoulders 80 and 82 provided in the flange member 70 and the front closure 72, respectively, a peripheral support for an endless air-permeable tobacco-impermeable flexible band 84, which is positioned in engagement with the shoulders 80 and 82 and pins 78 over substantially the whole periphery of the wheel 54. Intermediate support members other than the pins 78 may be provided, if desired. Any desired alternative manner of providing a supported air-permeable and tobacco-impermeable band between the flange member 70 and the front closure 72 may be used.

The flexible band 84 defines with the adjacent walls 86 and 88 of the flange member 70 and the front closure 72 respectively a peripheral tobacco-receiving and -conveying groove 90.

An enclosure 92 in communication with a source of vacuum, such as by vacuum header pipe 94 is under a subatmospheric pressure which causes suction across the band 84 through the fluid flow relationship between the enclosure 92 and the band 84 established by the central bore 96 in the hub 62.

Located on the diametrically opposite side of the large vacuum wheel 54 from the vacuum wheels 16 is a cigarette filler rod wrapper device 98 and feed mechanism 100 therefor of typically conventional construction. As seen in more detail in FIGS. 4 to 8, the feed mechanism 100 includes a belt 102 moving substantially horizontally in a trough 104 formed in a stationary block 105 towards the left as seen in the drawings and cigarette wrapping paper 106 positioned in engagement with the belt 102 and moving therewith into the throat of the wrapper device 98. The stationary trough 104 decreases in dimension towards the tongue 107 of the wrapper device 98, as may be seen from the cross-sectional views of FIGS. 5 to 8.

Figure 5:
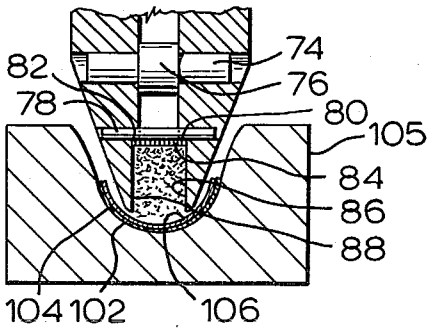
FIG. 5 is a sectional view taken on line 5—5 of FIG. 4.
Figure 6:
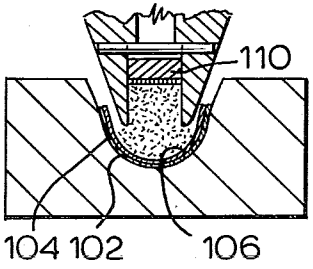
FIG. 6 is a sectional view taken on line 6—6 of FIG. 4.
Figure 7:
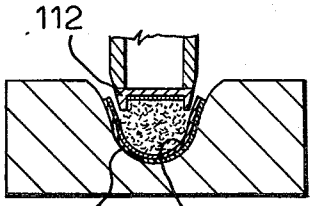
FIG. 7 is a sectional view taken on line 7—7 of FIG. 4.
Figure 8:
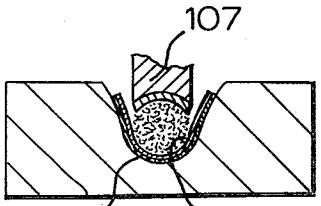
FIG. 8 is a sectional view taken on line 8—8 of FIG. 4.

As may be seen from the cross-section of FIG. 5, when the large wheel 54 is closest to the trough 104, the members 70 and 72 extend into the trough almost to the point of touching the paper 106. In view of the conventional dimensions of the trough 104, the radially outer portions of the members 70 and 72 are tapered as illustrated.

A roller 108 is positioned adjacent the tongue 107 of the wrapper device 98 and receives the belt 84 therearound so that in the region of the feed mechanism 100 from the point of nearest approach of the large wheel 54 to the throat 107, the belt 84 leaves contact with the pins 78 at approximately the point of nearest approach of the wheel 54 to the trough 104 and extends in the direction of movement of the belt 102 and converges therewith to the roller guide 108, the belt 84 being guided first by an upper stationary guide 110 which includes an integrally-formed depending side wall 112 over the latter portion of this travel.

The belt 84 passes in contact with roller 108 and a second roller 114 which may be mounted for adjustable movement to tension properly the belt 84 and then back into contact with the peripheral pins 78 of the wheel 54.

The stationary guide 110 also provides a vacuum shoe adjacent the outer periphery of the wheel 54 in the zone thereof adjacent the movement of the belt 84 from the wheel 54 to the roller 108.

A further vacuum shoe, typically external (not shown), may be provided adjacent the belt 84 from its recontact with the pins 78 to the left most vacuum wheel 16 to prevent application of suction across the belt 84 in this region.

A compressed air jet, or the like, may be provided adjacent the undersurface of the belt 84 between the rollers 108 and 114 for the application of compressed air to the belt 84 for cleaning thereof by removal of tobacco debris from the outer surface thereof.

A trimmer device 118 of any convenient construction may be provided adjacent the periphery of the wheel 54 between the vacuum wheels 16 and the feed mechanism 110 to trim tobacco from a filler rod conveyed by the large wheel 54.

The peripheral surface 18 and the belt surface 84 preferably are dimensioned less than 10 mm wide, typically about 5 to 10 mm, more particularly about 8.5 mm. The provision of the vacuum wheels 16 in the apparatus 10 permits the formation of a filler rod 120 of this width dimension at high speeds of 4,000 cigarettes per minute or greater.

OPERATION OF PREFERRED EMBODIMENT

In operation, the tobacco particles of the falling stream 14 are attracted to and captured by the outer surface of the peripheral surface 18 of each vacuum wheel 16 by the action of the suction applied across the surface 18.

On each peripheral surface 18, there is formed an elongated thin and narrow substream of tobacco composed of the attracted and captured tobacco particles. A "substream of tobacco" is one which itself is incapable of providing a tobacco filler rod but which when combined with the others formed from the broad stream produces a filler rod.

The substream formed on each surface 18 is conveyed under the influence of the suction to a discharge point which is the point at which the leading tobacco particles of the substream are adjacent to and moving in the same direction and speed as the belt 84. This location corresponds, with the vacuum wheels 16 rotating in anti-clockwise direction and the large wheel 54 rotating in a clockwise direction, to the location of the upstream arcuate end of the vacuum shoe 38.

The tobacco particles of the substream area released from the action of the suction across the peripheral surface 18 by the vacuum shoe 38 and the particles tend to lose contact with the surface 18 and this loss of contact is enhanced by the pressure of air blowing through the bore 44.

The tobacco particles released in this way then come under the influence of the suction applied across the surface of the band 84 so that the tobacco particles are captured and held by that suction.

For the left-most vacuum wheel 16 in FIG. 1, the tobacco particles released from the surface 18 of the wheels 16 are positioned on the belt 84. For the remainder of the vacuum wheels 16, the released particles are deposited on a layer of tobacco. In this way, a tobacco filler rod of the required thickness is built up on the belt 84 in its arcuate movement from the left-handmost wheel 16 to the right-handmost wheel 16.

The distance between the wheels 16 and the belt 84 or the partially-formed filler rod stream, whichever is the case, is such that the released tobacco particles substantially retain the same relative locations with respect to each other during transfer from the wheel 16 to the wheel 54. Thus, the coherent form of the conveyed substream is retained on the belt 84.

As mentioned above, the positioning of the peripheral surfaces 18 and the belt 84 is a compromise of the ideal arrangement. Ideally, the tobacco particles of each substream are transferred directly and intactly from the peripheral surface 18 to the belt 84 or onto tobacco thereon by tangential transfer, i.e. the substream particles at the point of release from the peripheral surface 18 and at the substantially simultaneous point of engagement with the belt 84 or tobacco thereon, as the case may be, lie on a line which is tangential to the surfaces.

However, such tangential transfer is possible only with a few of the right-hand wheels 16. For the remainder of the wheels 16, while the transfer is not absolutely tangential, nevertheless the tobacco particles released from the peripheral surfaces 18 substantially retain the same relative locations with respect to one another during the transfer, so that in each case the transfer of the substream from the surface 18 to the belt 84 may be considered to be substantially intact.

The filler rod 120 formed in this way may be considered to be formed by the layering of successive substreams one on top of another to form the filler rod of the required dimension. The filler rod 120 typically has about 20% of its depth situated above the level of the outer periphery of the members 70, 72, although any desired proportion may be so situated.

A single tobacco particle in the falling stream, therefore, is brought under the influence of suction applied across the surface 18 of one of the wheels 16 and is captured thereby. Under the influence of the friction induced by that suction, the tobacco particle is conveyed to the release point at which it is adjacent the belt 84 and is moving in the same direction as and at the same speed as the belt 84. Upon release from the suction on the wheel 16, it is immediately brought under the influence of suction applied across the belt 84 to be positioned thereon. The formation of the filler rod 120 from the tobacco particles of the falling stream 14, therefore, is controlled wholly by friction induced by suction.

Since the walls 86 and 88 adjacent the belt 84 move at the same speed as the belt 84, in contrast to the prior art procedure of formation of a filler rod on a moving surface between stationary side walls, the side wall friction problem, mentioned above, is avoided.

Additionally, the peripheral surface 18 and the belt 84 are dimensioned so that their width corresponds to the width of filler rod desired to be fed to the wrapping device 98 and this dimension is retained substantially constant to the wrapper feed device 100. This again is in contrast to the prior art and avoids the prior art side wall friction problem occasioned by narrowing of the width of the filler rod after formation thereof for feed to the wrapper feed device.

Assembly of the filler rod 120 by the layering of substreams of tobacco in accordance with this procedure results in a filler rod having improved characteristics as compared to a filler rod stream formed by conventional procedures.

Thus, the uniformity of the quantity of tobacco along the length of the filler rod is improved, thereby decreasing substantially the quantity of tobacco required to be trimmed from the filler rod. This allows less tobacco to be fed initially, less decrease in filling power resulting from the detrimental effects of trimming and improved runability.

In addition, the uniformity of particle size distribution in the filler rod 120 is improved, so that the classification problem mentioned above is avoided. Thus, since each individual substream of tobacco is relatively thin, there is very little classification of particle sizes possible therein. The subsequent layering of the substreams to form the filler rod 120 tends to balance out any classification of the particle sizes in the substreams.

It has been observed that the filling power of the filler rod 120 is greater than that which can be attributed to the improvement in filling power of the filler rod 120 achieved by decreased trimming. This unexpected observation is thought to arise from a high volume of air at the interface between adjacent individual substreams in the filler rod 120.

The filler rod 120 formed in this way then is conveyed under the influence of vacuum on the belt 84 past a trimmer 118 at which point excess tobacco may be removed to improve further the uniformity of the quantity of tobacco in the filler rod. The quantity of tobacco trimmed generally is below about 15% of the quantity of tobacco in the filler rod 120 and typically is about 12%.

The trimmed filler rod is conveyed on the belt 84 to the wrapper feed mechanism 100. As mentioned previously, in conventional cigarette making machines, the filler rod is conveyed from its formation to the wrapper feed mechanism between stationary side walls. Since the side walls adjacent the filler rod conveyed on the belt 84 move at the same speed thereas, this side wall friction problem of the prior art is avoided.

As may be seen from FIGS. 4 to 8, as the belt 84 leaves engagement with the pins 78 at the approximate point of nearest approach of the wheel 54, the wrapper feed mechanism 100 and the vacuum is released, the filler rod is transferred to the paper 106 and is fed into wrapper 98 thereon, contact between the belt 84 and the filler rod being terminated at the roller 108.

The natural tendency for the filler rod 120 to spread into the trough 104 upon removal of the lateral confining walls 86 and 88 and the suction hold is minimized by the usual high speed of operation of the apparatus.

The preferred embodiment of FIGS. 1 to 10 therefore is a superior rod-forming and conveying apparatus with improved run-ability suitable for the high speed formation of cigarettes of superior weight uniformity and particle size distribution which forms and conveys the filler rod at the narrow width required by the conventional wrapping means under the control of moving side walls. In addition, the increased filling power of the filler rod arising from the manner of assembly of the rod and the decreased trimming requirement decreases the quantity of tobacco required to provide a predetermined cigarette hardness, thereby resulting in more economic tobacco utilization.

DESCRIPTION AND OPERATION OF ALTERNATIVE EMBODIMENTS

Figure 11:
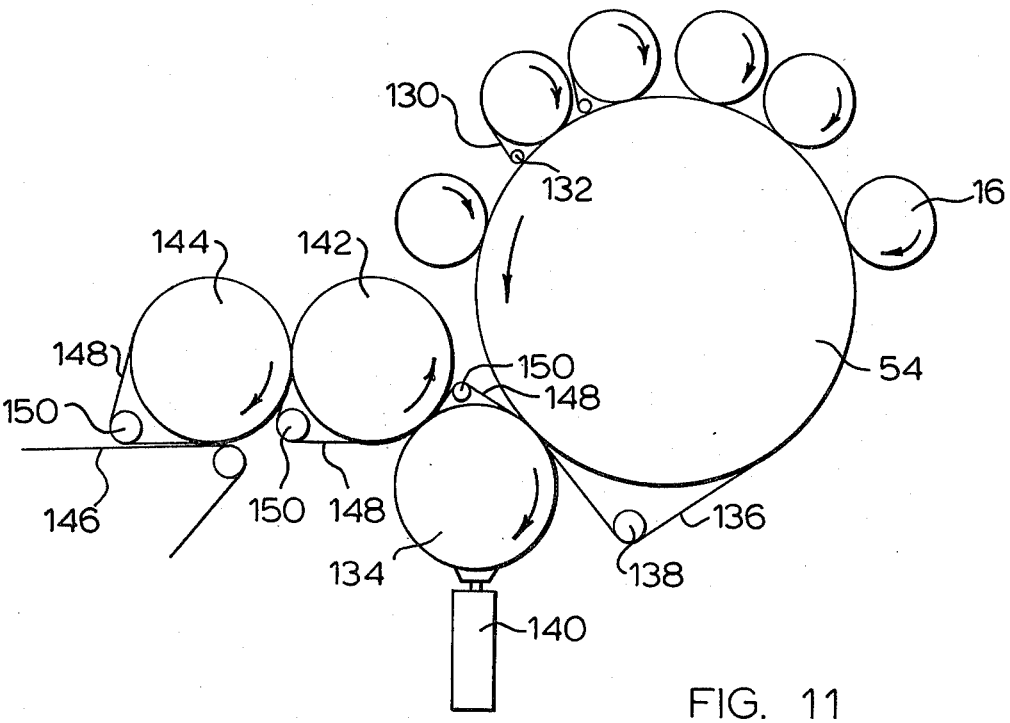
FIG. 11 is a schematic elevational representation of a cigarette making machine in accordance with a second embodiment of the invention.
Figure 12:
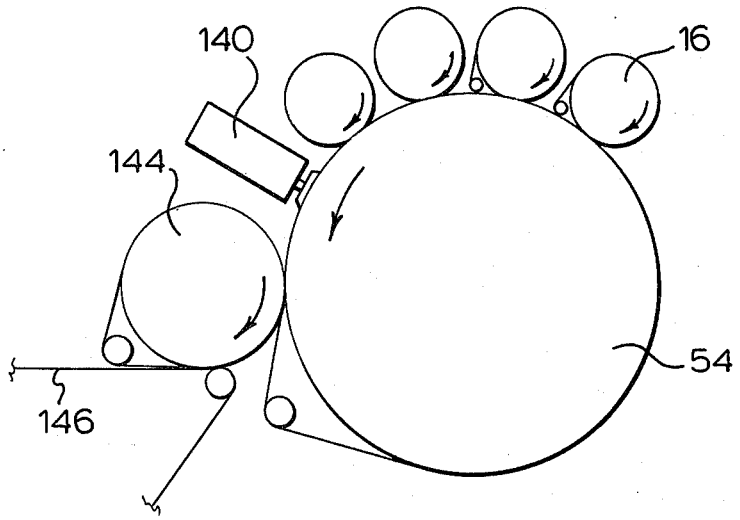
FIG. 12 is a schematic elevational representation of a cigarette making machine in accordance with a third embodiment of the invention.
Figure 13:
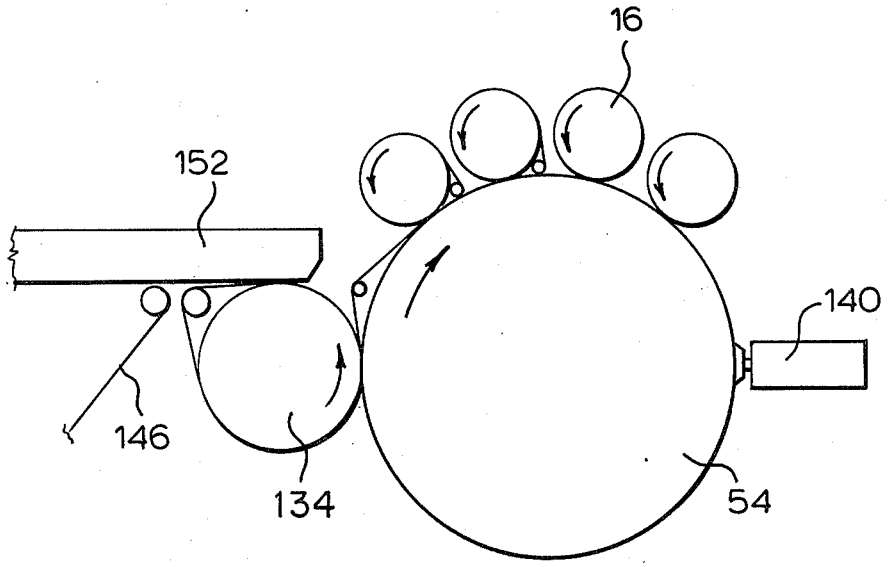
FIG. 13 is a schematic elevational representation of a cigarette making machine in accordance with a fourth embodiment of the invention.

Referring now to the alternative structures of the embodiments of FIGS. 11 to 13, there are illustrated similar filler rod forming and conveying apparatus including small substream-forming vacuum wheels and a large conveying wheel analogous to wheels 16 and 54 in the embodiment of FIGS. 1 to 10. These embodiments, however, also illustrate modifications to the vacuum wheel 16 structure and conveying systems for transfer of the filler rod to the wrapper feed where the latter is not located immediately below the wheel 54 as in the embodiment of FIGS. 1 to 10.

In FIG. 11, the wheels 16 and wheel 54 rotate in the opposite direction to their direction of rotation in the embodiment of FIGS. 1 to 10, and an air-permeable tobacco-impermeable endless ribbon or tape 130 is supported in the peripheral groove of the wheel 16 to constitute the forming and conveying surface for the substream in place of the peripheral surface 18. At the point of closest approach of each wheel 16 to the periphery of the wheel 54 and corresponding to the point of commencement of the vacuum shoe which extends arcuately in the direction of rotation of the wheel 16, the ribbon 130 loses contact with the foraminous surface and extends away from the periphery of the wheel 16, generally tangentially to the foraminous surface and tangentially to the outer periphery of the wheel 54, and passes round a suitably supported idler roller 132 before coming into contact again with the supporting surface of the wheel 16. By providing the ribbon 130 in this way, release of the substreams from the wheels 16 onto the periphery of the wheel 54 is assisted, and the necessity for a positive blow-off of the substream from the foraminous surface, as described in connection with the embodiment of FIGS. 1 to 10, may be avoided.

A rotatable wheel 134 is provided adjacent the periphery of the wheel 54 at the commencement of the vacuum shoe of the wheel 54 to receive the filler rod from the foraminous surface of the wheel 54 onto the periphery of the wheel 134 and for rotation in a clockwise direction. A continuous air-permeable tobacco-impermeable ribbon 136 may be provided in contact with the supporting surface of the wheel 54 over the majority of the arcuate length thereof, in analogous manner to band 84 in FIGS. 1 to 10. Where such a ribbon 136 is employed, it extends away from the wheel 54, usually substantially tangentially to the outer periphery of wheel 134 and tangentially to the foraminous surface of wheel 54 at the point of closest approach of wheels 54 and 134 to each other, and passes around roller 138. The provision of a ribbon in this manner assists in the transfer of the filler rod from the wheel 54 to the wheel 134, although in this embodiment it may be omitted, if desired.

The wheel 134 is constructed in analogous manner to wheels 16, and, reference is made to the description of the construction of the wheels 16 above, the basic difference lying in the relative diameters. The wheel 134 therefore possesses an air-permeable and tobacco-permeable recessed conveying surface through which air flow is induced by an internal vacuum and which has substantially the same width as the channels of the wheels 16 and the wheel 54 for the reasons discussed in detail above in connection with the embodiment of FIGS. 1 to 10. While the diameters of wheels 16 and 134 are illustrated to be different, this is a matter of choice and convenience.

A trimmer 140 of any convenient construction may be provided adjacent the periphery of wheel 134 to trim tobacco from the filler rod as desired. By trimming tobacco on wheel 134, the side of the filler rod which was sitting on the foraminous surface of the wheel 54 is trimmed. If desired, however, trimming of the other side of the rod may be carried out on the wheel 54, in similar manner to that described above in connection with the embodiment of FIGS. 1 to 10.

While the trimmer 140 is illustrated as being located adjacent the periphery of wheel 134, this arrangement is not essential, and the trimmer may be positioned at any other convenient location between the formation of the rod and the wrapping station.

Two further rotatable wheels 142 and 144 are provided between the wheel 134 and the entrance to the wrapping station of conventional construction, the paper feed 146 only being illustrated.

The wheels 142 and 144 are the same as wheel 134 and allow the transfer and vacuum conveying of the filler rod from the wheel 134 to the paper feed 146. Air-permeable and tobacco-impermeable ribbons 148 and free wheeling rollers 150 may be provided associated with each of wheels 134, 142 and 144 in analogous manner to the ribbon 130 and the roller 132 associated with each wheel 16 to assist in the removal of the filler rod from one peripheral groove on one wheel to another. At the discharge point from one wheel to another, i.e. the point of closest approach and the start of the vacuum shoe on the discharge wheel, the ribbon may extend tangentially from the outer periphery of the wheel to which the filler rod is discharged and tangentially to the foraminous surface of the wheel from which the filler rod is discharged.

Two wheels 142 and 144 are illustrated in FIG. 11 having a diameter the same as each other and the same as wheel 134. However, any number of wheels, of diameters varying from each other, may be used depending primarily on the distance between the rod-forming station and the wrapping station and on the necessity of discharging the filler rod in the same direction as the movement of the paper at the wrapping station.

In FIG. 12, there is illustrated a further embodiment wherein the transfer from the wheel 54 to the paper tape feed 146 if the filler rod is simplified as compared to the embodiment of FIG. 11, with the filler rod being transferred directly from the wheel 54 to wheel 144 from whence it is fed to the paper tape feed 146. Trimming of the rod using trimmer 140 occurs on the wheel 54 after formation thereof and prior to transfer to the wheel 144.

In the additional modification of FIG. 13, the filler rod again is trimmed using trimmer 140 while transported on wheel 54. In this modification, however, the wheels 54 and 16 rotate in the opposite direction to that in FIGS. 11 and 12.

The filler rod is transferred to a single wheel 134 which feeds the rod to the paper tape feed 146 by means of a vacuum bridge 152. The use of a vacuum bridge is less preferred, and its use in this embodiment may be avoided by the use of two wheels between wheel 134 and the paper tape feed 146, for example, equivalent to wheels 142 and 144 in FIG. 11, provided proper dimensioning and positioning of the various items is achieved.

SUMMARY

The present invention, therefore, provides a cigarette making machine having many important and improved characteristics. Modifications are possible within the scope of the invention.

What we claim is:

1. A cigarette making apparatus comprising a vertically-extending chute for confining and conveying a relatively wide stream of tobacco particles of narrow thickness falling towards the lower end thereof, a cylindrical vacuum wheel of substantial diameter greater than the width of said chute and located outside said lower end of said chute, said vacuum wheel being mounted for rotation about a substantially horizontal axis substantially perpendicular to a plane in which a flow path of said relatively wide stream is located, said cylindrical vacuum wheel including a front closure element and a rear annular element, joining and spacing means connecting said front closure element and said rear annular element in spaced apart relationship, support means associated with said front closure element and rear annular element for supporting an air-permeable and tobacco-impermeable tobacco filler rod-forming and-conveying surface over at least the filler rod-forming and-conveying arcuate length of said vacuum wheel, said filler rod-forming and-conveying surface being recessed between said front closure element and rear annular element adjacent the periphery of said vacuum wheel, and hollow hub means connected to said rear annular element and rotatably mounted on a fixed frame member, said hollow hub means having a central bore connecting a source of subatmospheric pressure and the space between said front closure element and said rear annular element to cause the application of suction across said filler rod-forming and-conveying surface, said filler rod-forming and-conveying surface being provided by a continuous band of flexible air-permeable and tobacco impermeable material, said support means being provided by continuous shoulders formed on said front closure element and said rear annular element for engagement by the edge portions of said band and a plurality of circumferentially-spaced pins extending between said shoulders for engagement of said band across the width thereof, vacuum interrupting means associated with said vacuum wheel and positioned to prevent the application of said suction over at least part of non-filler rod-forming and-conveying arcuate length of said vacuum wheel, filler wrapping means in rod-flow relationship with said vacuum wheel to receive a filler rod from said filler rod-conveying surface of said vacuum wheel to compress the so-received filler rod and wrap the compressed filler rod in paper to form a continuous cigarette rod from which individual cigarettes may be cut, and a plurality of substantially arcuately-arranged shallow cylindrical disc members positioned adjacent said lower end of said chute across the width thereof and adjacent an arcuate length of the periphery of said vacuum wheel, said disc members having substantially the same diameter and being mounted for rotation about axes parallel to the axis of rotation of said vacuum wheel, each of said disc members including an air-permeable and tobacco-impermeable substream-forming and-conveying suface extending arcuately over at least a major portion of the periphery of the disc member intercepting said plane, each of said disc members being hollow and the interior thereof having a pressure less than atmospheric to cause the application of suction across said substream-forming and-conveying surface to attract tobacco particles from said relatively wide stream so as to form a narrow substream of tobacco thereon and to convey said narrow substream thereon, each of said disc members including a vacuum interrupter positioned to prevent the application of said suction over a selected arcuate length of the disc member commencing at the approximate point of closest approach of said substream-forming and-conveying surface to said filler rod-forming and-conveying surface of said vacuum wheel for release of the tobacco particles of said substream from said peripheral surface and formation of a filler rod on said filler rod-forming surface of said vacuum wheel from the released tobacco particles.

2. The apparatus of claim 1 wherein said front closure element is dished outwardly and said rear annular element is dished inwardly to define a hollow chamber of increasing volume radially inwardly towards said hub means.

3. The apparatus of claim 1 wherein said filler rod wrapping means is provided on the diametrically-opposite side of said vacuum wheel from said disc members, whereby said rod-flow relationship is established.

4. The apparatus of claim 1 wherein said filler rod-forming and-conveying surface and said peripheral surfaces of said disc members each have the same width of from about 6 to 10 mm and the continuous band has the same width as said peripheral surfaces of said disc members.

5. The apparatus of claim 1 wherein said filler rod wrapping means is provided to one side of said vacuum means and including vacuum conveyor means between said vacuum wheel and said filler rod wrapping means comprising at least one disc like member mounted for rotation about an axis parallel to the axis of rotation of said vacuum wheel and including an air-permeable and tobacco-impermeable filler rod conveying surface recessed over at least a substantial length thereof and of width substantially that of said filler rod-forming and-conveying surface, said disc-like member being hollow and the interior thereof having a pressure less than atmospheric to cause the application of suction across said peripheral surface to convey a tobacco filler rod thereon, said disc-like member including a vacuum interrupter positioned to prevent the application of said suction over a selected arcuate length of said disc-like member.

6. A cigarette making apparatus comprising a vertically-extending chute for confining and conveying a relatively wide stream of tobacco particles of narrow thickness falling towards the lower end thereof, a cylindrical vacuum wheel of substantial diameter greater than the width of said chute and located outside said lower end of said chute, said vacuum wheel being mounted for rotation about a substantially horizontal axis substantially perpendicular to a plane in which a flow path of said relatively wide stream is located, said vacuum wheel including an air-permeable and tobacco-impermeable tobacco filler rod-forming and-conveying surface intercepting said plane and recessed between front and rear wall members of said vacuum wheel adjacent the periphery of said vacuum wheel over at least the filler rod-forming and conveying arcuate length of said vacuum wheel, said vacuum wheel being hollow and having an internal pressure less than atmospheric to cause the application of suction across said filler rod-forming and-conveying surface, vacuum interrupting means associated with said vacuum wheel and positioned to prevent the application of said suction over at least part of non-filler rod-forming and-conveying arcuate length of said vacuum wheel, filler wrapping means in rod-flow relationship with said vacuum wheel to receive a filler rod from said filler rod-conveying surface of said vacuum wheel to compress the so-received filler rod and wrap the compressed filler rod in paper to form a continuous cigarette rod from which individual cigarettes may be cut, and a plurality of substantially arcuately-arranged shallow cylindrical disc members positioned adjacent said other end of said chute across the width thereof and adjacent an arcuate length of the periphery of said vacuum wheel, said disc members having substantially the same diameter and being mounted for rotation about axes parallel to the axis of rotation of said vacuum wheel, each of said disc members including an air-permeable and tobacco-impermeable substream-forming and-conveying surface extending arcuately over at least a major portion of the periphery of the disc member intercepting said plane, each of said disc members including a front closure member and a rear annular member between which is mounted in recessed manner said substream-forming and-conveying surface, a hub means connected to said rear annular member, a stationary sleeve member located internally of said hub means and a stationary body member located externally of said hub means, said hub means being mounted for rotation relative to both said stationary sleeve member and said stationary body member, a subatmospheric pressure chamber located at one end of a passageway defined by said sleeve member to provide a subatmospheric pressure to a chamber at the other end of the passageway located beneath said peripheral surface to cause the application of suction across said substream-forming and-conveying surface to attract tobacco particles from said relatively wide stream so as to form a narrow substream of tobacco thereon and to convey said narrow substream thereon, and a stationary arcuate vacuum shoe mounted to said stationary sleeve member and preventing the application of said subatmospheric pressure to the underside of said peripheral surface over the length of said shoe, said vacuum shoe commencing at the approximate point of closest approach of said substream-forming and conveying surface of said vacuum wheel for release of the tobacco particles of said substream from said peripheral surface and formation of a filler rod on said filler rod-forming surface of said vacuum wheel from the released tobacco particles.

7. The apparatus of claim 6 wherein said cylindrical vacuum wheel includes a front closure element integral with said front wall member and a rear annular element integral with said rear wall member, joining and spacing means connecting said front closure element and said rear annular element in spaced apart relationship, support means associated with said front closure element and rear annular element for supporting said filler rod-forming and -conveying surface in recessed relation therebetween, and hollow hub means connected to said rear annular element and rotatably mounted in a fixed frame member, said hollow hub means having a central bore connecting a source of subatmospheric pressure and the space between said front closure element and said rear annular element whereby said suction is applied across said filler rod-forming and -conveying surface.

8. The apparatus of claim 7 wherein said rod-forming and-conveying surface is provided by a continuous band of flexible air-permeable and tobacco-impermeable material and said support means is provided by continuous shoulders formed on said front closure element and said rear annular element for engagement by the edge portions of said band and a plurality of circumferentially-spaced pins extending between said shoulders for engagement of said band across the width thereof.

9. The apparatus of claim 7 wherein said front closure is dished outwardly and said rear closure is dished inwardly to define a hollow chamber of increasing volume radially inwardly towards said hub means.

10. The apparatus of claim 6 wherein said filler rod wrapping means is provided on the diametrically-opposite side of said vacuum wheel from said disc members, whereby said rod-flow relationship is established.

11. The apparatus of claim 10 wherein said filler rod wrapping means includes a stationary trough-like cross-sectioned member extending substantially horizontally and transverse to said plane and having a decreasing cross-sectional dimension, a paper conveyor situated in said trough, and a continuous strip of cigarette paper in engagement with the upper surface of said conveyor for receiving a tobacco filler rod from said vacuum wheel and conveying said received filler rod to a tongue member of a wrapping apparatus at the downstream end of said trough member.

12. The apparatus of claim 11 wherein said filler rod-forming and-conveying surface is provided by a continuous band of flexible air-permeable and tobacco-impermeable material and including band guide means extending between the point of nearest approach of the vacuum wheel to the trough member and said tongue for guiding said band out of engagement with said support means and along the path of said trough member for compression of said filler rod between said band and said cigarette paper along the path of said trough member.

13. The apparatus of claim 12 wherein said band guide means includes a first roller located adjacent said tongue and a tensioning roller located downstream of said first roller for maintaining said band at a predetermined tension and guiding said band into engagement with said support means.

14. The apparatus of claim 11 wherein said front and rear wall members are shaped so that in cross section they include a flat inner surface portion and an outer surface portion tapered in a radially outward direction to the periphery of the vacuum wheel and said front and rear wall members extend into said trough member at the point closest of said vacuum wheel to said trough member.

15. The apparatus of claim 10 wherein said filler rod-forming and -conveying surface and said peripheral surfaces of said disc members each have the same width of less than about 10 mm.

16. The apparatus of claim 15 wherein said surfaces have the same width of from about 6 to 10 mm.

17. The apparatus of claim 6 wherein said filler rod wrapping means is provided to one side of said vacuum wheel and vacuum conveyor means is provided between said vacuum wheel and said filler rod wrapping means whereby said rod-flow relationship is established.

18. The apparatus of claim 17 wherein said vacuum conveyor means includes at least one disc-like member mounted for rotation about an axis parallel to the axis of rotation of said vacuum wheel and including an air-permeable and tobacco-impermeable filler rod conveying surface recessed over at least a substantial length thereof and of width substantially that of said filler rod-forming and -conveying surface, said disc-like member being hollow and the interior thereof having a pressure less than atmospheric to cause the application of suction across said peripheral surface to convey a tobacco filler rod thereon, said disc-like member including a vacuum interrupter positioned to prevent the application of said suction over a selected arcuate length of said disc-like member.

19. The apparatus of claim 18 wherein said vacuum conveyor means is constituted wholly by one or more of said disc-like members.

20. The apparatus of claim 6 including a source of air pressure and a bore connecting said source of air pressure to the vacuum shoe adjacent the commencement thereof to assist in the removal of tobacco particles from said peripheral surface.

21. The apparatus of claim 6 wherein a common subatmospheric pressure chamber is provided for all said disc members and said common subatmospheric pressure chamber is connected to a vacuum inducing means to provide subatmospheric pressure in said single subatmopsheric pressure chamber.

22. The apparatus of claim 6 wherein the substream-forming and -conveying surface of each disc member includes a first arcuate portion supported over a substream-forming and -conveying arcuate length of the disc member and a second nonarcuate portion which passes out of contact with said disc member at the commencement of said vacuum interruption means, passes about a roller element and into contact with said disc member adjacent to or before the termination of said vacuum interrupter means.

23. The apparatus of claim 6 including first drive means associated and in common with said disc members for driven rotation at substantially the same speed and second drive means associated with said vacuum wheel for driven rotation of said vacuum wheel at a speed and in a direction such that the substream-forming and -conveying surface of each disc member and the filler rod-forming surface of the vacuum wheel are moving at substantially the same speed and in the same direction at their nearest approach.

24. The apparatus of claim 6 wherein said chute includes a front wall and a rear wall, said rear wall extending from said one end to the other end and terminating immediately adjacent said disc members at a location spaced inwardly from said peripheral surface, said front wall extending from said one end towards the other end and terminating at a location spaced from said disc members and in alignment with the front edge of said peripheral surface.

25. A cigarette making apparatus comprising a vertically extending chute for confining and conveying a falling relatively wide stream of tobacco particles of narrow thickness falling towards the lower end thereof, a cylindrical vacuum wheel of substantial diameter greater than the width of said chute and located outside said lower end of said chute, said vacuum wheel being mounted for rotation about a substantially horizontal axis substantially perpendicular to a plane in which a flow path of said relatively wide stream is located, said vacuum wheel including an air-permeable and tobacco-impermeable tobacco filler rod-forming and-conveying surface intercepting said plane and recessed between front and rear wall members of said vacuum wheel adjacent the periphery of said vacuum wheel over at least the filler rod-forming and conveying arcuate length of said vacuum wheel, said vacuum wheel being hollow and having an internal pressure less than atmospheric to cause the application of suction across said filler rod-forming and-conveying surface, vacuum interrupting means associated with said vacuum wheel and positioned to prevent the application of said suction over at least part of non-filler rod-forming and-conveying arcuate length of said vacuum wheel, a plurality of substantially arcuately-arranged shallow cylindrical disc members positioned adjacent said lower end of said chute across the width thereof and adjacent an arcuate length of the periphery of said vacuum wheel, said disc members having substantially the same diameter and being mounted for rotation about axes parallel to the axis of rotation of said vacuum wheel, each of said disc members including an air-permeable and tobacco-impermeable substream-forming and-conveying surface extending arcuately over at least a major portion of the periphery of the disc member intercepting said plane, each of said disc members being hollow and the interior thereof having a pressure less than atmospheric to cause the application of suction across said substream-forming and-conveying surface to attract tobacco particles from said relatively wide stream so as to form a narrow substream of tobacco thereon and to convey said narrow substream thereon, each of said disc members including a vacuum interrupter positioned to prevent the application of said suction over a selected arcuate length of the disc member commencing at the approximate point of closest approach of said substream-forming and-conveying surface to said filler rod-forming and-conveying surface of said vacuum wheel for release of the tobacco particles of said substream from said peripheral surface and formation of a filler rod on said filler rod-forming surface of said vacuum wheel from the released tobacco particles, filler rod wrapping means in rod-flow relationship with said vacuum wheel and located on the diametrically-opposite side of said vacuum wheel from said disc members, said filler rod wrappping means including a stationary trough-like cross-sectional member extending substantially horizontally and transverse to said plane and having a decreasing cross-sectional dimension, a paper conveyor situated in said trough, and a continuous strip of cigarette paper in engagement with the upper surface of said conveyor for receiving a tobacco filler rod from said vacuum wheel and conveying said received filler rod to a tongue member of a wrapping apparatus at the downstream end of said trough member, said filler rod-forming and-conveying surface being provided by a continuous band of flexible air-permeable and tobacco-impermeable material, and band guide means extending between the point of nearest approach of the vacuum wheel to the trough member and said tongue for guiding said band out of engagement with said support means and along the path of said trough member for compression of said filler rod between said band and said cigarette paper along the path of said trough member.

26. The apparatus of claim 25 including tobacco trimming means located adjacent said vacuum wheel between said disc members and said filler rod wrapping means for trimming of tobacco from said filler rod.

27. The apparatus of claim 25 wherein said band guide means includes a first roller located adjacent said tongue and a tensioning roller located downstream of said first roller for maintaining said band at a predetermined tension and guiding said band into engagement with said support means.

28. The apparatus of claim 25 wherein said cylindrical vacuum wheel includes a front closure element integral with said front wall member and a rear annular element integral with said rear wall member, joining and spacing means connecting said front closure element and said rear annular element in spaced apart relationship, support means associated with said front closure element and rear annular element for supporting said filler rod-forming and-conveying surface in recessed relation therebetween, and hollow hub means connected to said rear annular element and rotatably mounted in a fixed frame member, said hollow hub means having a central bore connectiing a source of subatmospheric pressure and the space between said front closure element and said rear annular element whereby said suction is applied across said filler rod-forming and-conveying surface.

29. The apparatus of claim 28 wherein said filler rod-forming and-conveying surface is provided by a continuous band of flexible air-permeable and tobacco-impermeable material and said support means is provided by continuous shoulders formed on said front closure element and said rear annular element for engagement by the edge portions of said band and a plurality of circumferentially-spaced pins extending between said shoulders for engagement of said band across the width thereof.

30. The apparatus of claim 28 wherein said front closure is dished outwardly and said rear closure is dished inwardly to define a hollow chamber of increasing volume radially inwardly towards said hub means.

31. The apparatus of claim 25 wherein said front and rear wall members are shaped so that in cross section they include a flat inner surface portion and an outer surface portion tapered in a radially outward direction to the periphery of the vacuum wheel and said front and rear wall members extend into said trough member at the point closest of said vacuum wheel to said trough member.

32. The apparatus of claim 25 wherein said filler rod-forming and -conveying surface and said peripheral surfaces of said disc members each have the same width of from about 6 to 10 mm and the continuous band has the same width as said peripheral surfaces of said disc members.

33. A cigarette making apparatus comprising a vertically extending chute for confining and conveying a falling relatively wide stream of tobacco particles of narrow thickness falling towards the lower end thereof, a cylindrical vacuum wheel of substantial diameter greater than the width of said chute and located outside said lower end of said chute, said vacuum wheel being mounted for rotation about a substantially horizontal axis substantially perpendicular to a plane in which a flow path of said relatively wide stream is located, said vacuum wheel including an air-permeable and tobacco-impermeable tobacco filler rod-forming and -conveying surface intercepting said plane and recessed between front and rear wall members of said vacuum wheel adjacent the periphery of said vacuum wheel over at least the filler rod-forming and conveying arcuate length of said vacuum wheel, said vacuum wheel being hollow and having an internal pressure less than atmospheric to cause the application of suction across said filler rod-forming and -conveying surface, vacuum interrupting means associated with said vaccum wheel and positioned to prevent the application of said suction over at least part of non-filler rod-forming and -conveying arcuate length of said vacuum wheel, a plurality of substantially arcuately-arranged shallow cylindrical disc members positioned adjacent said lower end of said chute across the width thereof and adjacent an arcuate length of the periphery of said vacuum wheel, said disc members having substantially the same diameter and being mounted for rotation about axes parallel to the axis of rotation of said vaccum wheel, each of said disc members including an air-permeable and tobacco-impermeable substream-forming and -conveying surface extending arcuately over at least a major portion of the periphery of the disc member intercepting said plane, each of said disc members being hollow and the interior thereof having a pressure less than atmospheric to cause the application of suction across said substream-forming and -conveying surface to attract tobacco particles from said relatively wide stream so as to form a narrow substream of tobacco thereon and to convey said narrow substream thereon, each of said disc members including a vacuum interrupter positioned to prevent the application of said suction over a selected arcuate length of the disc member commencing at the approximate point of closest approach of said substream-forming and -conveying surface to said filler rod-forming and -conveying surface of said vacuum wheel for release of the tobacco particles of said substream from said peripheral surface and formation of a filler rod on said filler rod-forming surface of said vacuum wheel from the released tobacco particles, filler rod wrapping means in rod-flow relationship with said vacuum wheel and located on the diametrically-opposite side of said vacuum wheel from said disc members, said filler rod wrapping means including a stationary trough-like cross-sectional member extending substantially horizontally and transverse to said plane and having a decreasing cross-sectional dimension, a paper conveyor situated in said trough, and a continuous strip of cigarette paper in engagement with the upper surface of said conveyor for receiving a tobacco filler rod from said vacuum wheel and conveying said received filler rod to a tongue member of a wrapping apparatus at the downstream end of said trough member said front and rear wall members being shaped so that in cross-section they include a flat inner surface portion and an outer surface portion tapered in a radially outward direction to the periphery of the vacuum wheel and said front, said front and rear wall members extending into said trough member at the point of closest approach of said vacuum wheel to said trough member.

34. The apparatus of claim 33 wherein said cylindrical vacuum wheel includes a front closure element integral with said front wall member and a rear annular element integral with said rear wall member, joining and spacing means connecting with front closure element and said rear annular element in spaced apart relationship, support means associated with said front closure element and rear annular element for supporting said filler rod-forming and -conveying surface in recessed relation therebetween, and hollow hub means connected to said rear annular element and rotatably mounted in a fixed frame member, said hollow hub means having a central bore connecting a source of subatmospheric pressure and the space between said front closure element and said rear annular element whereby said suction is applied across said filler rod-forming and -conveying surface.

35. The apparatus of claim 34 wherein said filler rod-forming and -conveying surface is provided by a continuous band of flexible air-permeable and tobacco-impermeable material and said support means is provided by continuous shoulders formed on said front closure element and said rear annular element for engagement by the edge portions of said band and a plurality of circumferentially-spaced pins extending between said shoulders for engagement of said band across the width thereof.

36. The apparatus of claim 34 wherein said front closure is dished outwardly and said rear closure is dished inwardly to define a hollow chamber of increasing volume radially inwardly towards said hub means.

37. The apparatus of claim 33 wherein said filler rod-forming and -conveying surface and said peripheral surfaces of said disc members each have the same width of from about 6 to 10 mm and the continuous band has the same width as said peripheral surfaces of said disc members.

* * * * *